US008892226B2

(12) United States Patent
Densham et al.

(10) Patent No.: US 8,892,226 B2
(45) Date of Patent: Nov. 18, 2014

(54) AUDIO REPAIR METHODS AND APPARATUS

(75) Inventors: Rod Densham, Oxfordshire (GB); Nicolas Haynes, Oxfordshire (GB)

(73) Assignee: Sonnox Ltd, Oxforshire (GB)

( * ) Notice: Subject to any disclaimer, the term of this patent is extended or adjusted under 35 U.S.C. 154(b) by 864 days.

(21) Appl. No.: 12/898,046

(22) Filed: Oct. 5, 2010

(65) Prior Publication Data

US 2011/0081027 A1 Apr. 7, 2011

(30) Foreign Application Priority Data

Oct. 5, 2009 (GB) ..... 0917386.5

(51) Int. Cl.
*G06F 17/00* (2006.01)
*G10L 19/005* (2013.01)

(52) U.S. Cl.
CPC ..... *G10L 19/005* (2013.01); *G10H 2250/541* (2013.01)
USPC ..... 700/94

(58) Field of Classification Search
USPC ..... 700/94; 714/710; 381/56, 94.2, 94.3
See application file for complete search history.

(56) References Cited

U.S. PATENT DOCUMENTS 5,586,192 A 12/1996 De Bijl et al.
5,634,020 A * 5/1997 Norton ..... 715/727
5,740,146 A 4/1998 Webster
7,729,906 B2 * 6/2010 Saffer ..... 704/226
2005/0123150 A1 * 6/2005 Betts ..... 381/94.3
2006/0206316 A1 * 9/2006 Sung et al. ..... 704/207
2007/0100482 A1 * 5/2007 Cotey et al. ..... 700/94

FOREIGN PATENT DOCUMENTS

WO 2005017878 A1 2/2005

OTHER PUBLICATIONS

Search Report issued in the United Kingdom, Application No. GB0917386.5, date of search Nov. 25, 2009, 1 pg.

* cited by examiner

*Primary Examiner* — Fan Tsang
*Assistant Examiner* — David Siegel
(74) *Attorney, Agent, or Firm* — Faegre Baker Daniels LLP

(57) ABSTRACT

An audio recording may be repaired by implementing a processor to process the harmonic signal content of the audio recording; calculating a difference signal from the harmonic signal content by subtracting a predicted harmonic signal from a detected harmonic signal, the predicted harmonic signal being obtainable by a predictor means and the detected harmonic signal being detected by the processor; defining a threshold for the difference signal above which the difference signal indicates the occurrence of one or more acoustic excitation events; and thereby producing an events display which allows an operator to visually distinguish between indicated excitation events that are present as a result of a disturbance in the audio recording and indicated excitation events that are present as a result of natural harmonics in the audio recording; and repairing one or more of the displayed excitation events by a repair circuit which is in communication with the processor.

12 Claims, 10 Drawing Sheets

AUDIO REPAIR METHODS AND APPARATUS

CROSS-REFERENCES TO RELATED APPLICATIONS

This application claims priority to United Kingdom Application No. 0917386.5, filed Oct. 5, 2009, which is incorporated herein by reference in its entirety.

TECHNICAL FIELD

The invention relates to methods and apparatus for audio repair. More particularly the invention relates to methods and apparatus for audio repair which includes the use of audio repair programs that reside in an audio plug-in and which are compatible with audio work stations.

BACKGROUND

Typically audio repair and restoration techniques are applied to pre-recorded audio to remove imperfections such as hiss, crackle, noise and buzz from the audio while still retaining as much of the quality and authenticity of the original recording as possible. For example, audio restoration may be used to clean up an old vinyl record which has degraded over time. The vinyl record may have acquired various scratches and imperfections, and converting the recording to a digital medium such as an MP3 results in these imperfections also being transferred. FIG. 1 shows the harmonic waveform of a prior art audio recording which contains several disturbance events 10. These disturbance events can clearly be seen as large peaks in the amplitude which extend above the amplitude of normal harmonic waves 12.

FIG. 2 shows a prior art example of an amplitude plot of a waveform that includes a mixture of disturbance events 10. The disturbance types are broadly speaking characterized into 3 main categories, namely, pops, clicks and crackles. A pop 10*a* has a large amplitude and is typically 2 ms or longer in duration. A click 10*b* has a smaller amplitude and is shorter in duration, typically around 0.3 to 1.0 ms. Clicks don't tend to obliterate the underlying signal, but they are still audible to the listener. Crackles 10*c* are even smaller in amplitude and are less than 0.3 ms in duration. The crackles are often heard as persistent background noise. FIG. 3 shows an expanded view of a portion of the amplitude plot of FIG. 2 in which a click 10*c* is identified.

Prior art audio repair and restoration techniques work by streaming a sample of audio into a predictor algorithm which attempts to follow the harmonic profile of the signal. The predictor algorithm looks at a stream of samples and is then able to identify within a certain degree of error where the following samples in the stream will lie in amplitude. A profile may be modelled by the predictor algorithm and such a modelled profile may then be used to identify disturbance events 10 by comparing the actual harmonic profile with that predicted by the algorithm. Significant deviances from the predicted profile are identified as disturbances. It should be noted that the algorithm determines which events are classified as pops, clicks and crackles based on their harmonic profile and that these above distinctions are merely a general classification.

One of the problems associated with the use of such predictor algorithms is distinguishing events caused by the natural harmonics of certain types of audio from genuine distortion events. Brass music in particular is known to be difficult for the predictor algorithms to accurately model. In these cases registered events are typically not caused by disturbance, but are inherent and vital to the character of the brass music. Repairing these events makes the resultant music sound dull and affects the integrity of the sound.

Another similar problem associated with the known use of predictor algorithms is that the user is not easily able to select which portions of recorded audio should be repaired and which should not.

Cleaning up audio recordings that are in the form of dialogue or which include sections of dialogue also creates additional problems. Different sets of parameters are often required during speech compared to those that are required for the pauses between speaking. Setting the parameters too aggressively means that many of the natural harmonics of the recorded voice would be repaired thus affecting the sound quality. In this case it may be preferable to use lower settings because the dialogue masks the disturbance events. However, in such a case much of the background noise would escape repair and this would be particularly exposed during the pauses. One known method for overcoming this is by automation. In this way someone manually goes through the recording to determine which events are speech and which are not, and they set the parameters accordingly. This approach, however, is laborious and prone to errors.

SUMMARY

In some embodiments, the invention provides an apparatus and methods that enable a user to distinguish genuine disturbance events from those that are natural characteristics of the music. In some embodiments, the invention provides improved methods and apparatus for audio repair and restoration of dialog recordings that are easier to use, more reliable and more efficient.

In an embodiment of the invention, a method of repairing an audio recording includes implementing a processor to process a harmonic signal content of the audio recording. A difference signal may be calculated from the harmonic signal content by subtracting a predicted harmonic signal from a detected harmonic signal. The predicted harmonic signal is obtainable by a predictor circuit while the detected harmonic signal is detected by the processor. A threshold for the difference signal may be defined, the threshold defining a value above which the difference signal indicates the occurrence of one or more acoustic excitation events. A maximum amplitude of each indicated excitation event may be displayed as a function of a maximum duration of the excitation event. An events display is produced that allows an operator to visually distinguish between indicated excitation events that are present as a result of a disturbance in the audio recording and indicated excitation events that are present as a result of natural harmonics in the audio recording. One or more of the displayed excitation events may be repaired by a repair circuit that is in communication with the processor.

In some embodiments, the method includes modelling the predicted harmonic signal by a predictor circuit applying an algorithm to the detected harmonic signal.

In some embodiments, the method includes adjusting the processor's ability to indicate one or more excitation events by redefining the threshold for the difference signal. In this way the method may further include lowering the threshold to just above the level of a background noise signal which is present in the difference signal.

In some embodiments, the method may further include operating a sensitivity controller thereby enabling an operator to define a sensitivity level for the difference signal, the sensitivity level allowing the operator to select a proportion of the total of the displayed excitation events for repair by the repair circuit.

In some embodiments, the method may further include defining a zone on the events display and excluding excitation events inside the zone from repair.

In some embodiments, the method may include defining threshold and sensitivity levels for a dialogue section in an audio recording independently from defining the threshold and sensitivity levels for the pauses between dialogue in the dialogue section of the audio recording.

In some embodiments, the method may include presetting the defined threshold and sensitivity levels for a dialogue section in an audio recording, and presetting separate defined threshold and sensitivity levels for the pauses between dialogue in an audio recording, and applying the corresponding preset threshold and sensitivity levels upon detecting a section of dialogue or one or more pauses between sections of dialogue in an audio recording. In this way the method may also include categorizing the difference signal as applying to a section of dialogue, or applying to one or more pauses between sections of dialogue by detecting the frequency of the harmonic signal content of the audio recording and applying the preset threshold and sensitivity levels on the basis of the detected frequency.

In some embodiments, the method may include recording threshold parameters, sensitivity parameters, repaired excitation events or excluded excitation events of the difference signal in real time. In addition, the method may further include auditioning of the processed difference signal in real time by the operator listening to the processed difference signal in real time where the excitation events have been repaired or the excitation events have been included.

In an embodiment of the invention, an audio recording repair apparatus includes a processor that is configured to process a harmonic signal content of a recorded audio signal. The apparatus includes a difference signal generator that is operable to subtract a predicted harmonic signal content of the audio signal from a detected harmonic signal content of the audio signal so as to calculate a difference signal that is used to indicate the occurrence of one or more acoustic excitation events. The apparatus includes a repair circuit that is operable to remove excitation events as well as an events display. The events display is configured to display the maximum amplitude of each excitation event as a function of the maximum duration of the excitation event. The events display is configured to allow an operator to distinguish between excitation events that are present as a result of a disturbance in the audio signal and excitation events that are present as a result of natural harmonics of the audio signal.

In some embodiments, the apparatus further includes controls operable to enable an operator to define a threshold for the difference signal above which the difference signal indicates the occurrence of one or more acoustic excitation events, and further sensitivity controls operable to enable an operator to define a sensitivity level for the difference signal, the sensitivity level allowing the operator to select a proportion of the total of the displayed excitation events for repair by the repair circuit.

In some embodiments, the apparatus may include an exclusion tool operable to define a zone on the events display inside which excitation events are excluded from being sent to the repair circuit.

In some embodiments, the apparatus may include controls operable to adjust the threshold and sensitivity levels for the dialogue of a section of dialogue in an audio recording independently from the threshold and sensitivity levels for the pauses between sections of dialogue in an audio recording.

BRIEF DESCRIPTION OF THE DRAWINGS

FIG. 5 shows an events display with disturbance events having been registered for use in repairing an audio recording according to an embodiment of the invention, and which forms part of an audio plug-in.

FIG. 6 shows an events display where natural harmonics of brass instruments in an audio recording have been registered as excitation events, and which forms part of an audio plug-in.

FIG. 7 shows an events display which is in dialogue mode for use in repairing audio comprising dialogue according to an embodiment of the invention, and which forms part of an audio plug-in.

DETAILED DESCRIPTION

This invention provides methods used and apparatus for repairing an audio recording. Repairing recorded audio also includes restoring old and pre-recorded audio. One embodiment of the invention provides a method of repairing an audio recording that includes the steps of implementing a processor to process the harmonic signal content of the audio recording; calculating a difference signal from the harmonic signal content by subtracting a predicted harmonic signal from a detected harmonic signal, the predicted harmonic signal being obtainable by a predictor circuit and the detected harmonic signal being detected by the processor; defining a threshold for the difference signal above which the difference signal indicates the occurrence of one or more acoustic excitation events; displaying the maximum amplitude of each indicated excitation event as a function of the maximum duration of the excitation event, and thereby producing an events display which allows an operator to visually distinguish between indicated excitation events that are present as a result of a disturbance in the audio recording and indicated excitation events that are present as a result of natural harmonics in the audio recording; and repairing one or more of the displayed excitation events by a repair circuit which is in communication with the processor.

In some embodiments, the predicted harmonic signal may be modelled by a predictor circuit applying an algorithm to the detected harmonic signal.

Another embodiment of the invention provides audio repair apparatus including a processor capable of processing an audio signal; a difference signal generator operable to subtract the predicted harmonic signal content of the audio signal from the detected harmonic signal content of the audio signal so as to calculate a difference signal which is used to indicate the occurrence of one or more acoustic excitation events; a repair circuit operable to remove excitation events; and an events display where the maximum amplitude of each excitation event is displayed as a function of the maximum duration of the excitation event, and which allows the operator to distinguish between excitation events that are present as a result of a disturbance in the audio signal and excitation events that are present as a result of natural harmonics of the audio signal.

Figure 1:
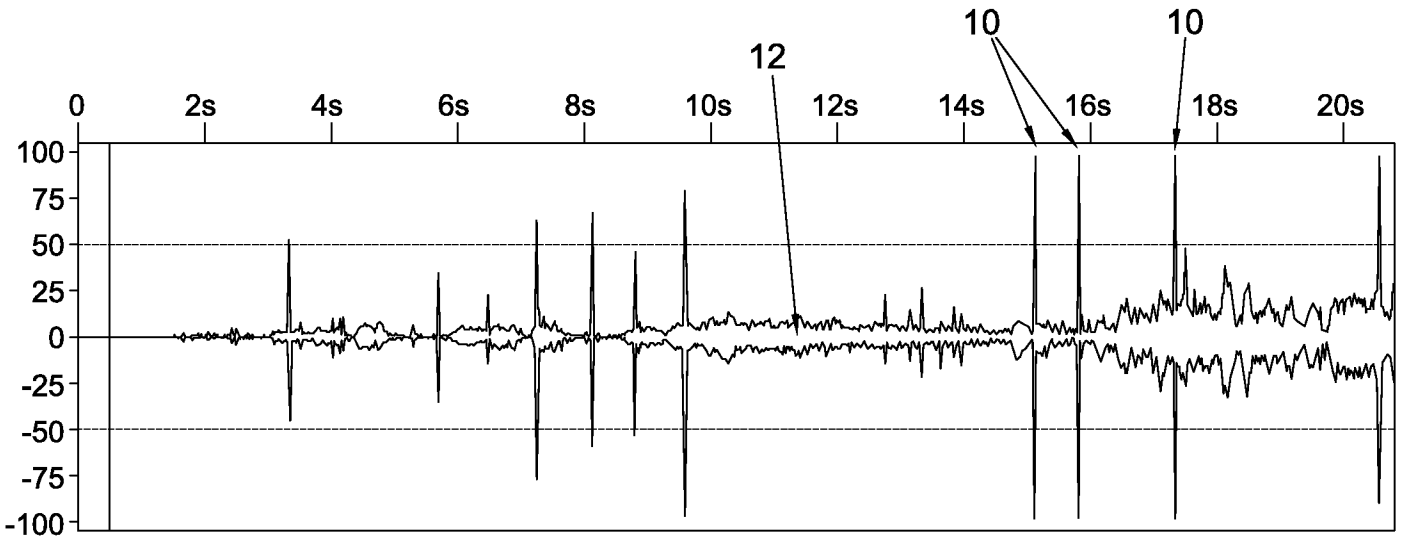
Fig. 1 PRIOR ART
FIG. 1 shows a graphic representation of a prior art harmonic waveform of an audio recording which contains several disturbance events.
Figure 2:
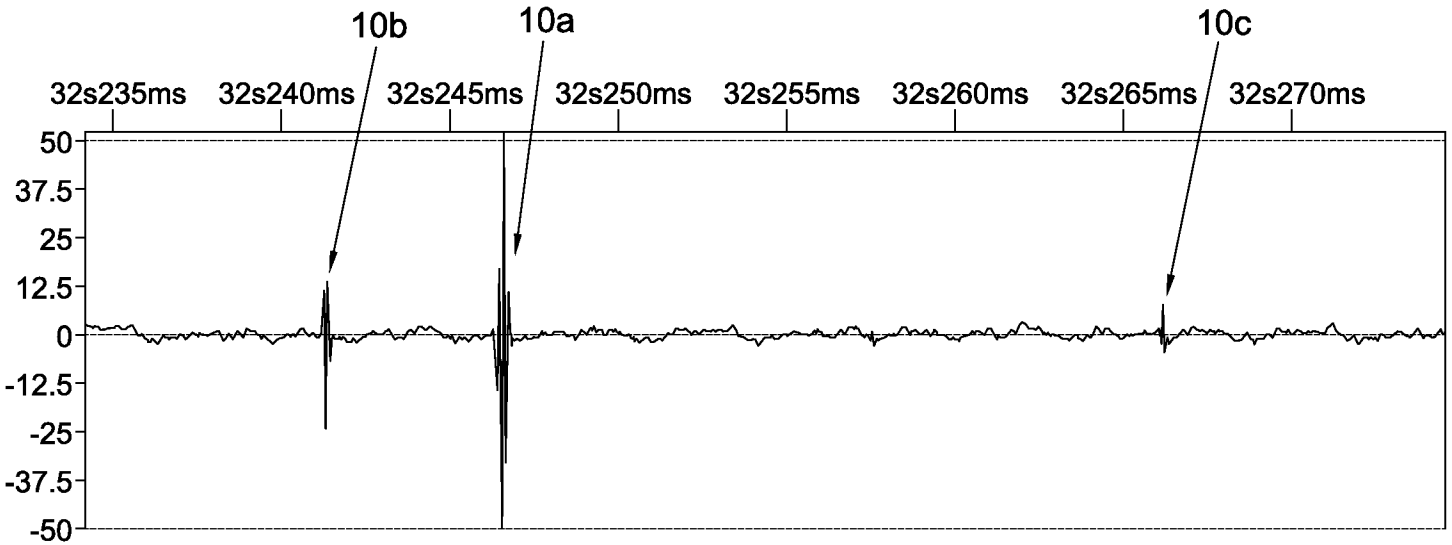
Fig. 2 PRIOR ART
FIG. 2 shows a graphic representation of a prior art amplitude plot of a waveform including a mixture of disturbance events.
Figure 3:
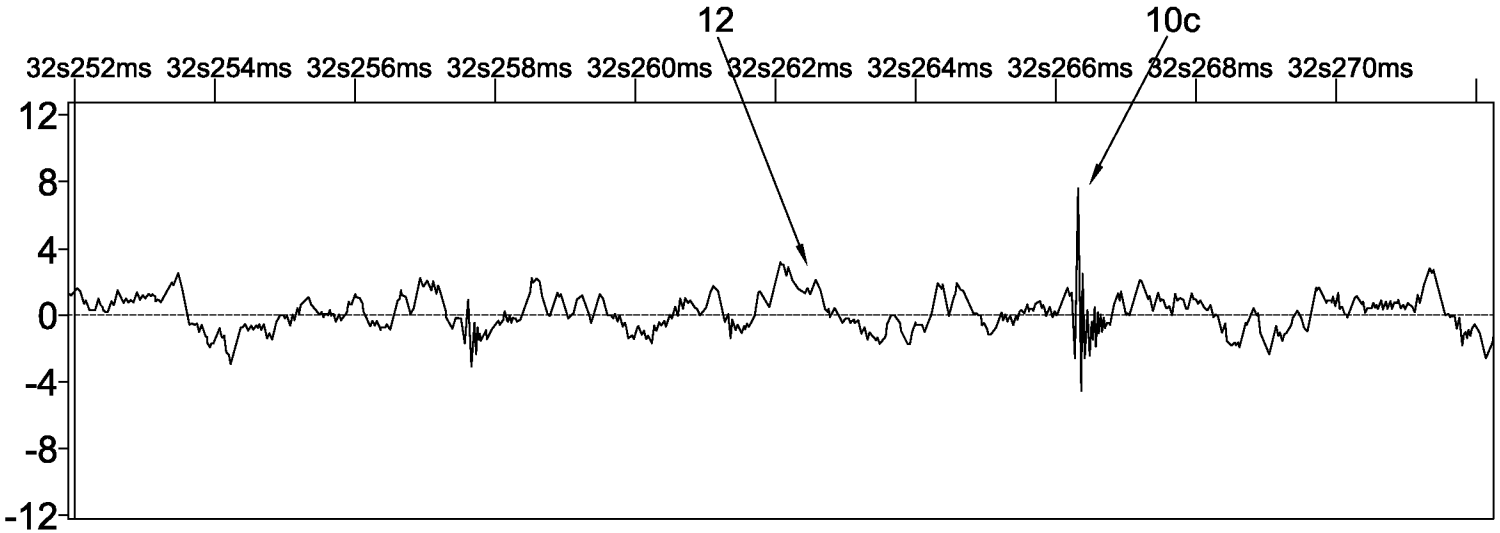
Fig. 3 PRIOR ART
FIG. 3 shows a graphic representation of a prior art amplitude plot of a waveform including an expanded view of a portion of the plot of FIG. 2.
Figure 4:
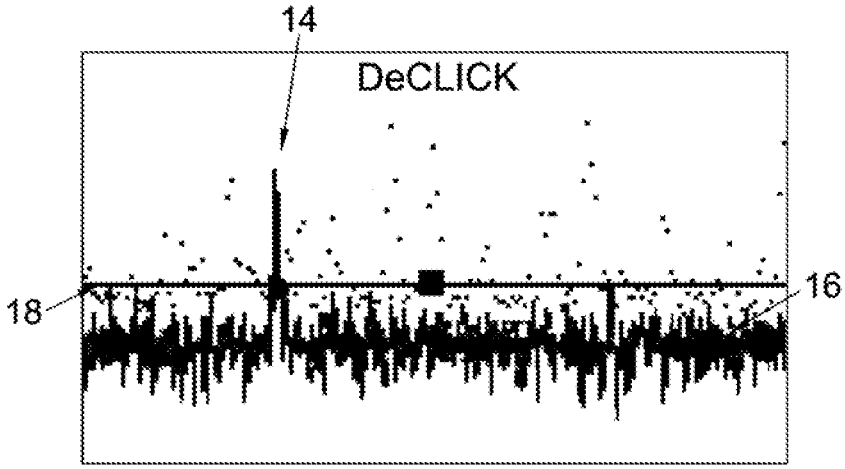
FIG. 4 shows a graphic representation of a plot of a difference signal used in repairing an audio recording according to an embodiment of the invention.

FIG. 4 shows a plot of the difference signal generated by subtracting the algorithm predicted signal value from the actual value of the audio sample as detected. A peak 14 in the difference signal 16 can be seen. This peak represents a disturbance event in the audio, its amplitude and duration corresponding to the amplitude and duration of a click present in the audio.

The horizontal line in FIG. 4 is the threshold indicator 18. When a peak in amplitude is above the threshold an excitation event is registered. In some embodiments, the processor's ability to indicate one or more excitation events may be adjusted by redefining the threshold for the difference signal. This effectively involves adjusting the receptiveness of the processor to excitation events. The threshold indicator may be lowered or raised to select fewer or more events, dependent on their amplitude.

In some embodiments, the threshold may be lowered to just above the level of a background noise signal which is present in the difference signal. Positioning the threshold just above the background noise, as has been shown to be done in FIG. 4, increases the processor's receptiveness and ability to indicate one or more excitation events, but at the same time provides tolerance by placing the threshold in a certainty zone which is just above the level of the background noise signal.

In some embodiments, the maximum amplitude of each excitation event is displayed using an events display apparatus as a function of the maximum duration such that the operator of the apparatus is able to distinguish between excitation events that are caused by disturbance and excitation events that are natural harmonics. The events display apparatus further includes a processor capable of processing a recorded audio signal; a difference signal generator operable to subtract the predicted harmonic signal content of the audio signal from the detected harmonic signal content of the audio signal so as to calculate a difference signal which is used to indicate the occurrence of one or more acoustic excitation events; a repair circuit operable to remove excitation events; and an events display where the maximum amplitude of each excitation event is displayed as a function of the maximum duration of the excitation event, and which allows the operator to distinguish between excitation events that are present as a result of a disturbance in the audio signal and excitation events that are present as a result of natural harmonics of the audio signal.

Figure 5:
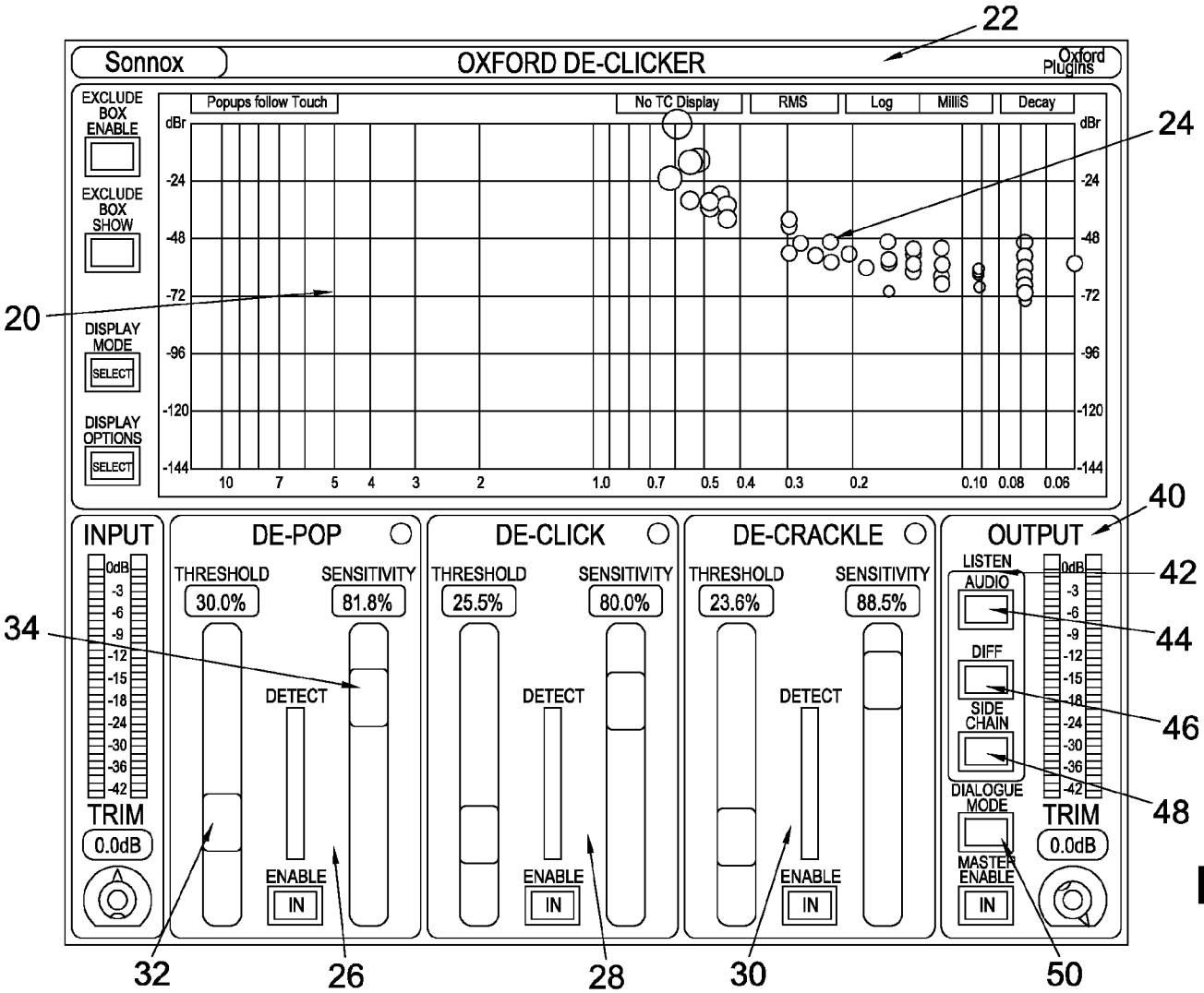

In some embodiments, the maximum amplitude of each excitation event may be displayed as a function of the maximum duration of the excitation event thereby producing an events display allowing the operator to visually distinguish between excitation events that are present as a result of disturbance and excitation events that are present as a result of natural harmonics. FIG. 5 shows an events display 20 in the uppermost panel of an electronic audio plug-in module 22 used for audio repair in an electronic audio workstation. Excitation events 24 caused by disturbances in the audio signal are shown to have been registered. When an excitation event 24 is registered by the processor it is displayed on the events display 20. The shortest excitation events 24 can be found on the right and the most energetic (i.e. those with the highest amplitude) at the top of the events display 20. Generally crackles will be found in the lower right, clicks are in the middle and pops in the upper left of the events display 20.

In some embodiments, the invention relates to methods and apparatus for audio repair which includes the use of audio repair programs that reside in audio plug-in modules and which are compatible with audio work stations. It will be noted that audio plug-in module 22 may alternatively include hardware which resides on a device compatible with an audio work station.

In some embodiments, the apparatus further includes controls operable to redefine the threshold within the difference signal which define excitation events and further sensitivity controls operable to send a different proportion of the total identified excitation events to the repairer. These controls enable an operator to define a threshold for the difference signal above which the difference signal indicates the occurrence of one or more acoustic excitation events. Further sensitivity controls enable an operator to define a sensitivity level for the difference signal, the sensitivity level allowing the operator to select a proportion of the total of the displayed excitation events 24 for repair by the repair circuit.

Below the events display 20 shown in FIG. 5 are three sections in the audio plug-in module 22, namely, De-Pop 26, De-Click 28 and De-Crackle 30. Detected excitation events caused by disturbances in the audio signal which are defined generally as pops occur in the region of the events display 20 immediately above the De-Pop 26 section, and likewise for detected excitation events caused by disturbances defined generally as clicks and crackles. In some embodiments, each of the detected types of excitation events 24, namely, pops, clicks and crackles are displayed in a different color in the events display 20.

Each section 26, 28 and 30 also has a threshold controller 32 and a sensitivity controller 34 associated therewith. The threshold controller 32 is operable to determine how many excitation events 24 are detected and the sensitivity controller 34 is operable to determine how many of those detected events are sent to the repair circuit to be repaired.

There is further provided a method of operating the sensitivity controller 34 thereby enabling the operator to define a sensitivity level for the difference signal, the sensitivity level allowing the operator to select a proportion of the total of the displayed excitation events 24 for repair by the repair circuit, also known as the repairer, which is in communication with the processor. The repairer operates in a sequential manner so that a pop in a recorded audio signal processed by the processor will be diverted straight to the repairer and won't be fed through the processor to be processed by click or crackle parameters. In this way the threshold and sensitivity levels for clicks and crackles may be set much lower allowing disturbance to be repaired progressively.

Figure 6:
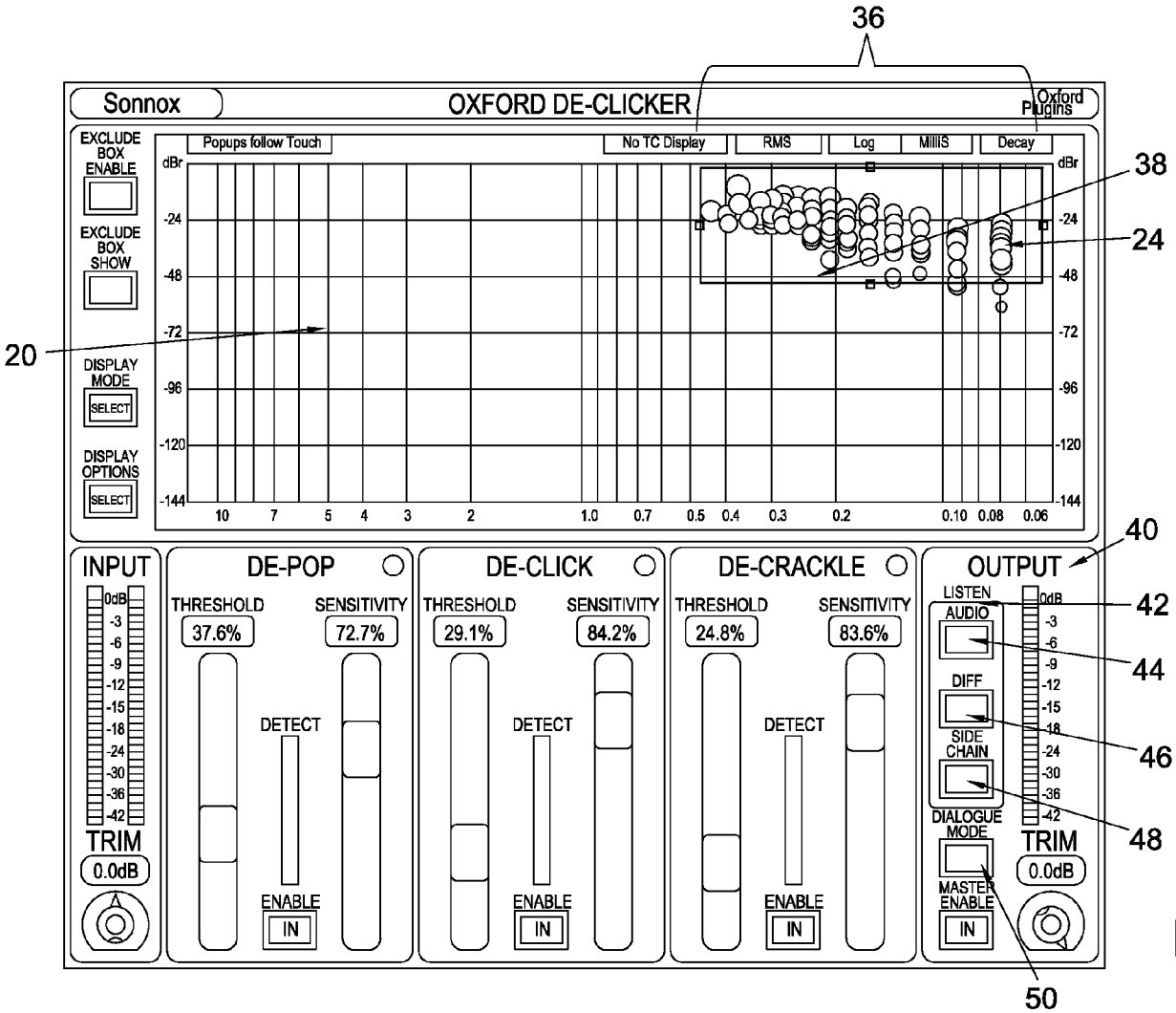

FIG. 5 specifically shows the events display 20 with registered excitation events 24 that are caused by a crackly audio recording of music. Aside from displaying the trend of the longer duration events as being larger in amplitude, these disturbance events 24 are randomly distributed on the events display 20. By contrast, FIG. 6 shows an events display 20 where natural harmonics of brass instruments have registered as excitation events 24. Here the excitation events 24 are more regularly distributed in clusters and auditioning aurally by the operator will confirm that the events correspond to a specific brass section of the music. Displaying the excitation events 24 on the events display 20 in this way permits the operator to distinguish between excitation events which are due to distortion and those which are due to the natural harmonics of the music. The natural harmonics such as those produced by brass instruments appear as regularly distributed bands of excitation events rather than being randomly distributed.

In some embodiments, an exclusion zone 36 may be defined on the events display 20 and excitation events 24 inside the zone 36 may be excluded from repair. As can be seen in FIG. 6 the operator has defined an exclusion zone 36 around the excitation events 24 which were caused by the natural harmonics of the brass instruments in the music. Excluding these excitation events 24 prevents them from being sent to the repairer and preserves the character of the original brass sound in the music being repaired.

In some embodiments, an exclusion tool apparatus is operable to define a zone on the events display inside which excitation events are excluded from being sent to the repair circuit for repair. The exclusion tool in the audio plug-in module 22 is operated by the operator clicking a cursor on the events display 20 and dragging an exclusion box 38 around the exclusion zone 36 such that all the excitation events 24 for which repair is not required are encapsulated. Each depicted excitation event that occurs within the box 38 will not be repaired and for ease of identification is highlighted in a different color to those that are outside the box 38 on events display 20. The whole box 38 may be dragged by the operator or the drag handles on each of the sides of the box 38 may be used by the operator to re-position or re-size the box 38 accurately.

In some embodiments, threshold parameters, sensitivity parameters, repaired excitation events and excluded excitation events may be recorded in real time. This automation method permits the operator to alter parameters and exclude excitation events in real time while the audio is being processed and streamed through the processor. The choices made by the operator are recorded as instructions by the processor in real time and the resultant changes made to the audio recording can be played back allowing the operator to listen to the result. This process may be repeated several times permitting the operator to alter and edit the audio recording until the final version is repaired as required.

As can be seen on FIGS. 5 and 6 the apparatus further includes an output panel 40 visible on audio plug-in module 22. The listen (or auditioning) section 42 of the output panel 40 includes an audio button 44, a diff button 46 and a side chain button 48. The diff button 46 permits the operator to listen to the difference between the input and the processed output. Here the audio streamed through the processor will primarily contain the disturbance events, however, if the operator were to hear any music or dialogue from the recording in this stream, it would be an indication that the chosen parameters were either too aggressive or that there is a necessity to exclude more excitation events than originally envisaged.

In some embodiments, at least one portion of the repaired audio recording may be auditioned by streaming the repaired audio and excluded excitation events in real time. This is accomplished by auditioning the processed difference signal in real time by the operator listening to the processed difference signal in real time where the excitation events have been repaired or the excitation events have been included. The operator may alternatively listen to the repaired audio to determine whether it does in fact sound cleaned up or repaired, or whether more aggressive repair parameters are required (i.e. by hearing that disturbance could still be heard in the repaired version).

Figure 7:
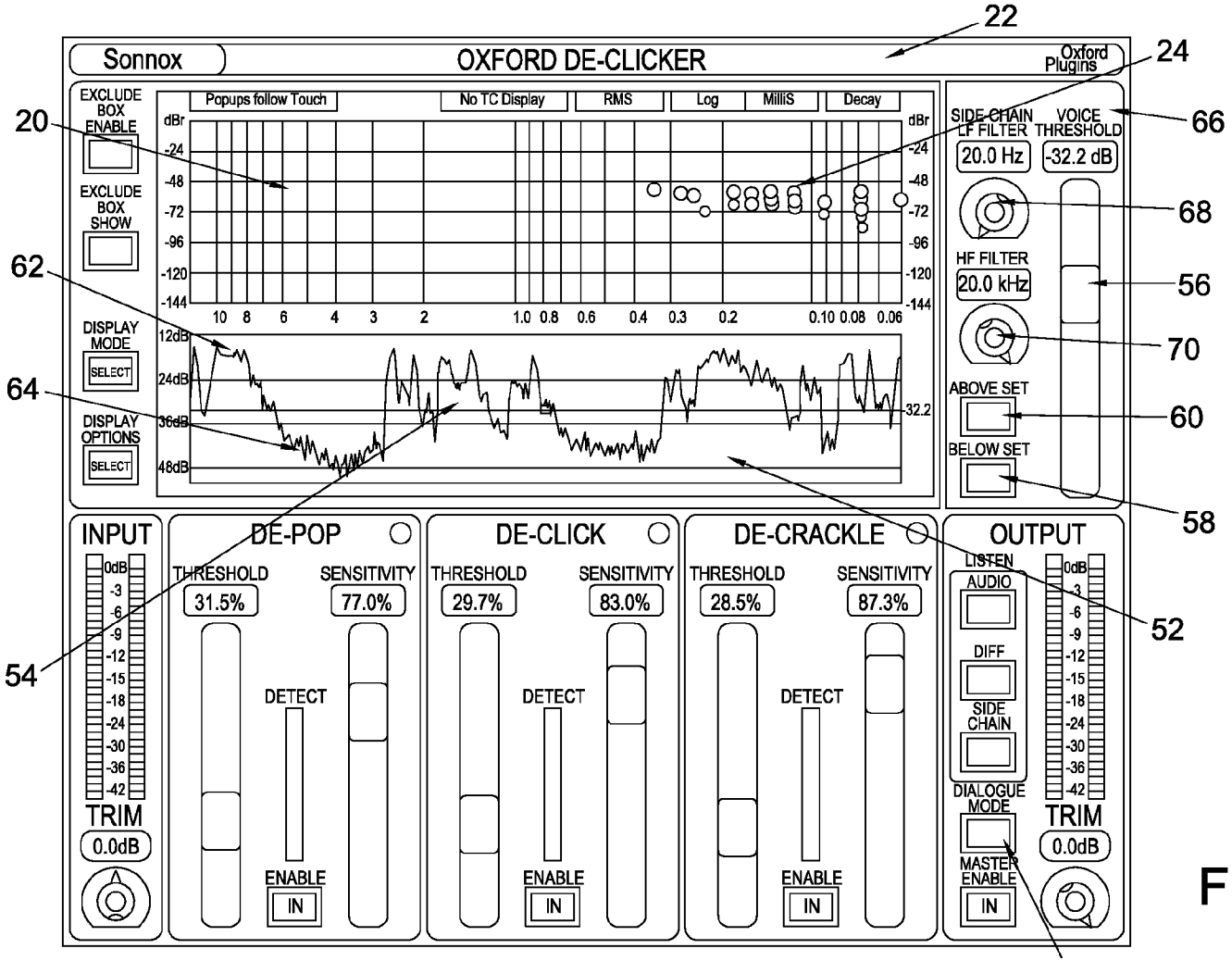

The output panel 40 also includes a dialogue mode button 50. FIG. 7 shows the apparatus in dialogue mode where the dialogue button 50 has been activated by the operator. In some embodiments, setting threshold and sensitivity levels for dialogue may be set independently from the threshold and sensitivity levels for the pauses in the dialogue. This is accomplished by defining threshold and sensitivity levels for a dialogue section in an audio recording independently from defining the threshold and sensitivity levels for the pauses between dialogue in the audio recording.

The dialogue mode incorporates an amplitude plot panel 52 below the events display 20. Upon switching to the dialogue mode the operator first sets the voice threshold 54 which is moveable up and down on the amplitude plot panel 52 below the events display 20 by operating the voice threshold slider 56. For the best results the operator will set the voice threshold 54 just above the background level where the speaker pauses. The signal appearing above the voice threshold 54 is the speech and is indicated in one colour, the signal below are the pauses and is indicated in another colour in the audio plug-in module 22. The operator is then able to set different threshold and sensitivity parameters for above and below the voice threshold 54. The below controls 58 allow the parameters to be set for signal corresponding to the pauses in speech, whereas the above controls 60 allow a more appropriate set of parameters to be assigned to the signal corresponding to the speech.

A further feature of the dialogue mode that makes it even more flexible is the incorporation of a side chain. In some embodiments, the difference signal may undergo side chain splitting by presetting threshold and sensitivity levels for the dialogue and presetting separate threshold and sensitivity levels for the pauses and applying the corresponding preset threshold and sensitivity levels upon detecting dialogue or a pause. This is accomplished by presetting the defined threshold and sensitivity levels for a dialogue section in an audio recording, and presetting separate defined threshold and sensitivity levels for the pauses between dialogue in a dialogue section in an audio recording, and applying the corresponding preset threshold and sensitivity levels upon detecting a section of dialogue or one or more pauses between sections of dialogue in an audio recording.

The dialogue mode defines when the difference signal is above the voice threshold 54 corresponding to the dialogue 62 and also when the signal is below the voice threshold 54 where the signal corresponds to a pause 64 in the dialogue. Without the side chain, the splitting occurs on the basis of the amplitude of the detected signal. However, when the side chain mode is functional, the above and below splitting is determined by the level of the signal within a particular frequency band.

In some embodiments, the difference signal may be categorized as being dialogue or alternatively as a pause by detecting the frequency of the harmonic signal content of the audio recording and applying the side chain splitting on the basis of frequency band. In this way the method includes categorizing the difference signal as applying to a section of dialogue, or applying to one or more pauses between sections of dialogue by detecting the frequency of the harmonic signal content of the audio recording and applying the preset threshold and sensitivity levels on the basis of the detected frequency. The dialog and pauses are clearly distinguishable from each other as the frequency bands of each are non-overlapping and distinct.

In some embodiments, the apparatus includes a control apparatus operable to adjust the threshold and sensitivity levels for the dialogue independently from the threshold and sensitivity levels for the pauses in the dialogue.

These controls can be found on the dialogue gate panel 66 when the audio plug-in module 22 is in the dialogue mode. In some embodiments, the apparatus is operable to side chain split the difference signal according to preset threshold and sensitivity levels for both the dialogue and the pauses. The LF filter control 68 and the HF filter control 70 on the dialogue gate panel 66 permit the operator to alter the parameters at which the frequency bands are detected. The difference signal is capable of being categorized as either dialogue or as a pause on the basis of the detected frequency band.

In some embodiments, the invention relates further to methods and apparatus for audio repair which includes the use of audio repair programs that reside in audio plug-in modules and which are compatible with audio work stations.

Figure 8:
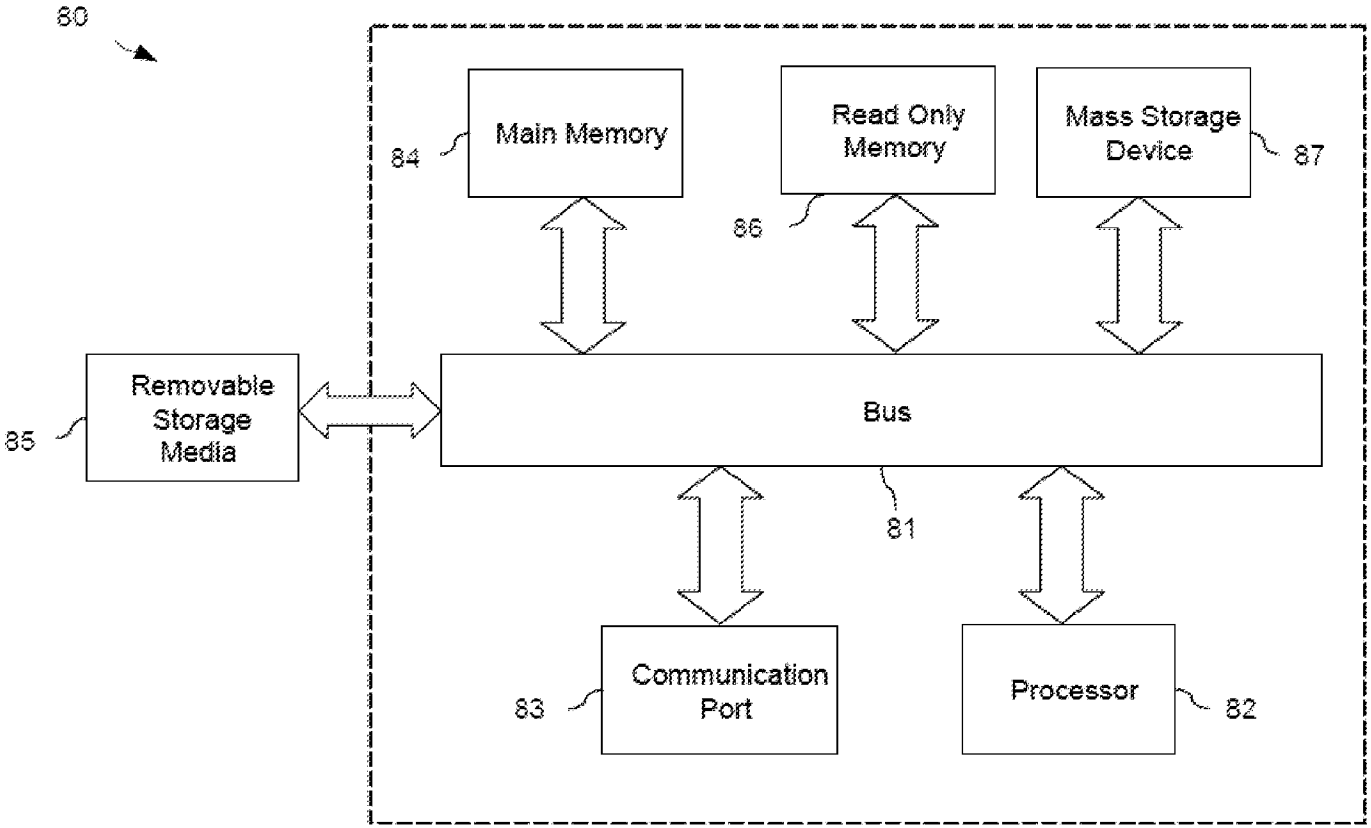
FIG. 8 is an example of a computer system that may be used to carry out the methods described herein.

In some embodiments, the audio repair methods described herein as well as the described apparatus for audio repair may be manifested at least partially as software operating a computer system. FIG. 8 is an example of a computer system 80. According to the present example, the computer system includes a bus 81, at least one processor 82, at least one communication port 83, a main memory 84, a removable storage media 85, a read only memory 86, and a mass storage 87.

Processor(s) 82 can be any known processor, such as, but not limited to, an Intel® Itanium® or Itanium 2® processor(s), or AMD® Opteron® or Athlon MP® processor(s), or Motorola® lines of processors. Communication port(s) 83 can be any of an RS-232 port for use with a modem based dialup connection, a 10/100 Ethernet port, or a Gigabit port using copper or fiber, for example. Communication port(s) 83 may be chosen depending on a network such a Local Area Network (LAN), Wide Area Network (WAN), or any network to which the computer system 80 connects. Main memory 84 can be Random Access Memory (RAM), or any other dynamic storage device(s) commonly known to one of ordinary skill in the art. Read only memory 86 can be any static storage device(s) such as Programmable Read Only Memory (PROM) chips for storing static information such as instructions for processor 82, for example.

Mass storage 87 can be used to store information and instructions. For example, hard disks such as the Adaptec® family of SCSI drives, an optical disc, an array of disks such as RAID (e.g. the Adaptec family of RAID drives), or any other mass storage devices may be used, for example. Bus 81 communicably couples processor(s) 82 with the other memory, storage and communication blocks. Bus 82 can be a PCI/PCI-X or SCSI based system bus depending on the storage devices used, for example. Removable storage media 85 can be any kind of external hard-drives, floppy drives, flash drives, IOMEGA® Zip Drives, Compact Disc—Read Only Memory (CD-ROM), Compact Disc—Re-Writable (CD-RW), or Digital Video Disk—Read Only Memory (DVD-ROM), for example. The components described above are meant to exemplify some types of possibilities. In no way should the aforementioned examples limit the scope of the invention, as they are only exemplary embodiments.

In some embodiments, the processor 82 may carry out the methods described above. For example, the processor 82 may process the harmonic signal content of an audio recording and may calculate the difference signal. The processor 82 may define the threshold and may, via the communication port 83, display the maximum amplitude of the excitation events. In some embodiments, the processor 82 may provide the function of the repair circuit. The processor 82 may carry out a variety of different processes useful in carrying out the methods described herein. In some embodiments, the audio repair apparatus may be the computer system 80.

Figure 9:
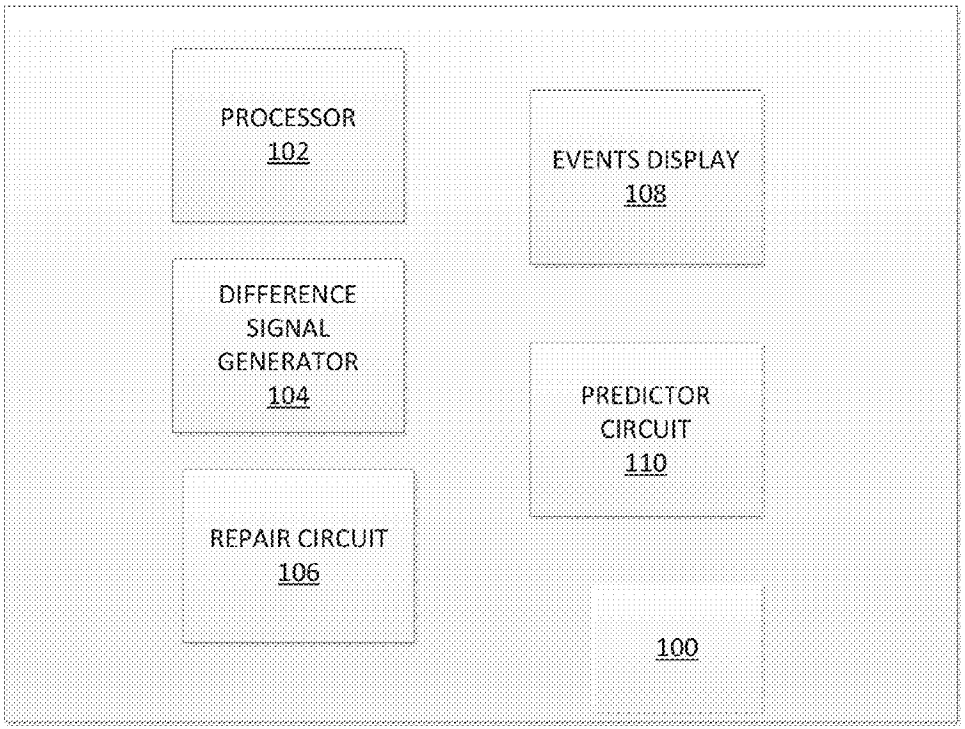
FIG. 9 is a schematic illustration of an audio recording repair apparatus.

FIG. 9 provides a schematic illustration of an audio recording repair apparatus 100. The audio recording repair apparatus 100 includes a processor 102, a difference signal generator 104, a repair circuit 106, an events display 108 and a predictor circuit 108.

Figure 10:
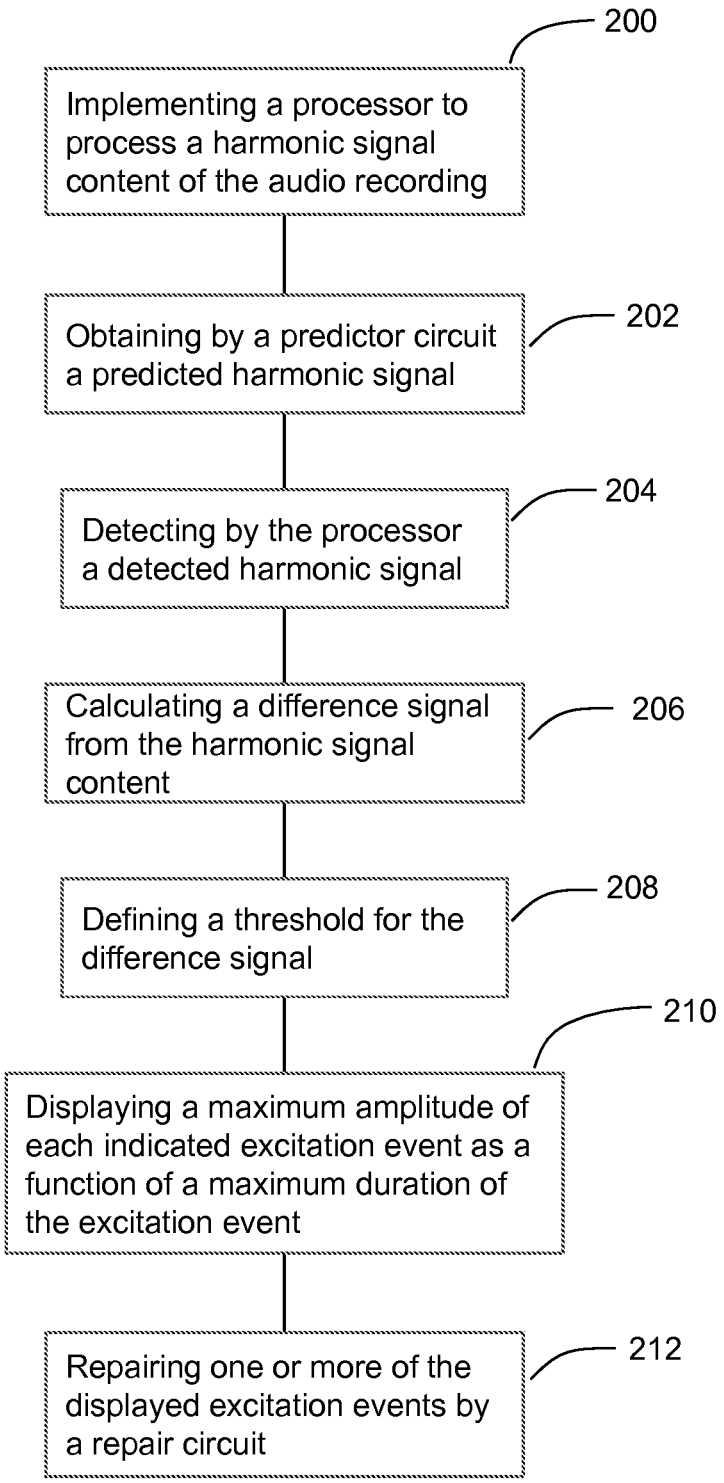
FIG. 10 is a flowchart diagram illustrating one example of a method of repairing an audio recording.

FIG. 10 is a flowchart diagram illustrating one example of a method of repairing an audio recording. At 200, the method includes implementing a processor to process a harmonic signal content of the audio recording. At 202, the method includes obtaining by a predictor circuit a predicted harmonic signal. At 204, the method includes detecting by the processor a detected harmonic signal. At 206, the method includes calculating a difference signal from the harmonic signal content by subtracting the predicted harmonic signal from the detected harmonic signal. At 208, the method includes defining a threshold for the difference signal above which the difference signal indicates an occurrence of one or more acoustic excitation events. At 210, the method includes displaying a maximum amplitude of each indicated excitation event as a function of a maximum duration of the excitation event, and thereby producing an events display which allows an operator to visually distinguish between indicated excitation events that are present as a result of a disturbance in the audio recording and indicated excitation events that are present as a result of natural harmonics in the audio recording. At 212, the method includes repairing one or more of the displayed excitation events by a repair circuit which is in communication with the processor.

The following is claimed:

1. A method of repairing an audio recording, the method comprising the steps of:

implementing a processor to process a harmonic signal content of the audio recording;

calculating a difference signal from the harmonic signal content by subtracting a predicted harmonic signal from a detected harmonic signal, the predicted harmonic signal being obtainable by a predictor circuit and the detected harmonic signal being detected by the processor;

defining a threshold for the difference signal above which the difference signal indicates an occurrence of one or more acoustic excitation events;

displaying a maximum amplitude of each indicated excitation event as a function of a maximum duration of the excitation event, and thereby producing an events display which allows an operator to visually distinguish between indicated excitation events that are present as a result of a disturbance in the audio recording and indicated excitation events that are present as a result of natural harmonics in the audio recording;

repairing one or more of the displayed excitation events by a repair circuit which is in communication with the processor;

adjusting the processor's ability to indicate one or more excitation events by redefining the threshold for the difference signal; and operating a sensitivity controller thereby enabling an operator to define a sensitivity level for the difference signal, the sensitivity level allowing the operator to select a proportion of the total of the displayed excitation events for repair by the repair circuit.

2. A method as claimed in claim 1, further comprising modeling the predicted harmonic signal by a predictor circuit applying an algorithm to the detected harmonic signal.

3. A method as claimed in claim 1, further comprising lowering the threshold to just above the level of a background noise signal which is present in the difference signal.

4. A method as claimed in claim 1, further comprising defining a zone on the events display and excluding excitation events inside the zone from repair.

5. A method as claimed in claim 1, further comprising defining threshold and sensitivity levels for a dialogue section in an audio recording independently from defining the threshold and sensitivity levels for the pauses between dialogue in the dialogue section of the audio recording.

6. A method as claimed in claim 5, further comprising presetting the defined threshold and sensitivity levels for a dialogue section in an audio recording, and presetting separate defined threshold and sensitivity levels for the pauses between dialogue in an audio recording, and applying the corresponding preset threshold and sensitivity levels upon detecting a section of dialogue or one or more pauses between sections of dialogue in an audio recording.

7. A method as claimed in claim 4, further comprising categorizing the difference signal as applying to a section of dialogue, or applying to one or more pauses between sections of dialogue by detecting the frequency of the harmonic signal content of the audio recording and applying the preset threshold and sensitivity levels on the basis of the detected frequency.

8. A method as claimed in claim 1, further comprising recording threshold parameters, sensitivity parameters, repaired excitation events or excluded excitation events of the difference signal in real time.

9. A method as claimed in claim 1, further comprising auditioning of the processed difference signal in real time by the operator listening to the processed difference signal in real time where the excitation events have been repaired or the excitation events have been included.

10. Audio recording repair apparatus comprising:

a processor configured for processing a harmonic signal content of a recorded audio signal;

a difference signal generator operable to subtract a predicted harmonic signal content of the audio signal from a detected harmonic signal content of the audio signal so as to calculate a difference signal which is used to indicate the occurrence of one or more acoustic excitation events;

a repair circuit operable to remove excitation events;

an events display where the maximum amplitude of each excitation event is displayed as a function of the maximum duration of the excitation event, and which allows the operator to distinguish between excitation events that are present as a result of a disturbance in the audio signal and excitation events that are present as a result of natural harmonics of the audio signal; and controls operable to enable an operator to define a threshold for the difference signal above which the difference signal indicates the occurrence of one or more acoustic excitation events, and further sensitivity controls operable to enable an operator to define a sensitivity level for the difference signal, the sensitivity level allowing the operator to select a proportion of the total of the displayed excitation events for repair by the repair circuit.

11. The apparatus as claimed in claim 8, further comprising an exclusion tool operable to define a zone on the events display inside which excitation events are excluded from being sent to the repair circuit.

12. The apparatus as claimed in claim 8, further comprising controls operable to adjust the threshold and sensitivity levels for the dialogue of a section of dialogue in an audio recording independently from the threshold and sensitivity levels for the pauses between sections of dialogue in an audio recording.

* * * * *